United States Patent [19]

Delprato et al.

[11] Patent Number: 5,013,639

[45] Date of Patent: May 7, 1991

[54] INCORPORATION OF HYDROPHOBIC PHOTOGRAPHIC ADDITIVES INTO HYDROPHILIC COLLOID COMPOSITIONS

[75] Inventors: Ivano Delprato; Agostino Baldassarri, both of St. Paul, Minn.

[73] Assignee: Minnesota Mining and Manufacturing Company, St. Paul, Minn.

[21] Appl. No.: 508,643

[22] Filed: Apr. 12, 1990

Related U.S. Application Data

[63] Continuation-in-part of Ser. No. 316,026, Feb. 27, 1989, abandoned.

[51] Int. Cl.[5] ..... G03C 1/005

[52] U.S. Cl. ..... 430/546; 430/631

[58] Field of Search ..... 430/546, 631

[56] References Cited

U.S. PATENT DOCUMENTS

| | | | |
|---|---|---|---|
| 3,936,303 | 2/1976 | Shiba et al. | 430/546 |
| 4,399,213 | 8/1983 | Watanabe et al. | 430/523 |
| 4,554,247 | 11/1985 | Yamashita et al. | 430/622 |
| 4,857,449 | 8/1989 | Ogawa et al. | 430/546 |

*Primary Examiner*—Charles L. Bowers, Jr.
*Assistant Examiner*—Janet C. Baxter
*Attorney, Agent, or Firm*—Gary L. Griswold; Walter N. Kirn; Mark A. Litman

[57] ABSTRACT

Aliphatic diesters of alkylenedicarboxylic acid compounds are water-immiscible high-boiling organic solvents useful for dispersing hydrophobic photographic additives in hydrophilic colloid compositioins which are incorporated into light-sensitive silver halide photographic materials.

In particular, said aliphatic diesters of alkylenedicarboxylic acid compounds correspond to the general formula

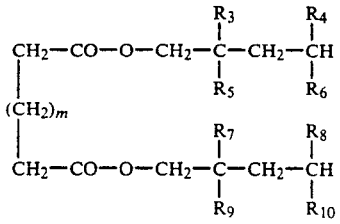

wherein $R_3$, $R_4$, $R_5$, $R_6$, $R_7$, $R_8$, $R_9$ and $R_{10}$, equal or different, each represents a hydrogen atom or a lower alkyl group, with the proviso that at least one of $R_3$, $R_5$, $R_7$ and $R_9$ is an alkyl group or at least one pair of $R_4$ and $R_6$ or $R_8$ and $R_{10}$ are both alkyl groups and the total number of carbon atoms in $R_3$, $R_4$, $R_5$ and $R_6$ and the total number of carbon atoms in $R_7$, $R_8$, $R_9$ and $R_{10}$ is, each, less than 12, and m is 0 to 10.

18 Claims, No Drawings

INCORPORATION OF HYDROPHOBIC PHOTOGRAPHIC ADDITIVES INTO HYDROPHILIC COLLOID COMPOSITIONS

This application is a continuation-in-part of application Ser. No. 07/316,026, filed Feb. 27, 1989, now abandoned.

FIELD OF THE INVENTION

The present invention relates to light-sensitive silver halide photographic materials comprising hydrophobic photographic additives dispersed with the aid of water-immiscible high boiling organic solvents in hydrophilic colloid component layers.

BACKGROUND OF THE ART

Light-sensitive silver halide photographic materials are comprised of hydrophilic colloid component layers containing various photographic additives. Said photographic additives are generally incorporated in the hydrophilic colloid compositions for forming said component layers by dissolving them in water or in water-miscible organic solvents and adding the resulting solution to said compositions.

Generally, however, many photographic additives are difficult to dissolve in water and, even when soluble in water-miscible organic solvents, they are incompatible with hydrophilic colloid compositions when incorporated therein through organic solvents. This is the case of many photographic additives which are rendered non- diffusible within the photographic layers by including a long hydrophobic carbon atom chain (the so called "ballasting chain") in their structural formula. Hydrophobic (ballasted) photographic additives include, for example, dye-forming couplers, DIR compounds, UV absorbers, anti-oxidants, image stabilizers, etc.

Typically, the process of incorporating such hydrophobic photographic additives into hydrophilic colloid components layers of photographic materials, such as silver halide emulsion layers, protective layers, intermediate layers and the like, consists of incorporating the photographic additives into hydrophilic colloid coating compositions for said layers. The -photographic additives are incorporated in the form of a dispersion of fine droplets consisting of a water-immiscible high boiling organic solvent in which said hydrophobic additives have been dissolved.

According to said dispersion technique, as described in U.S. Pat. No. 2,322,027, the hydrophobic photographic additives are generally dissolved in water-immiscible high boiling organic solvents (also called in the art permanent solvents, crystalloidal solvents, oil-type solvents, oil-formers and the like) and the resulting organic solution is added to an aqueous composition containing a hydrophilic colloid (gelatin) and a dispersing agent (surfactant). The mixture is then passed through a homogenizing apparatus (colloidal mill) to form a dispersion of fine droplets of said organic solvent containing the hydrophobic photographic additives. In some cases it may be advantageous to facilitate the dissolution of the additives by use of an auxiliary water-immiscible low boiling organic solvent, which is removed afterwards by evaporation, as described e.g. in U.S. Pat. Nos. 2,801,170, 2,801,171 and 2;949,360. The obtained dispersion is then mixed with the hydrophilic colloid composition (gelatin silver halide emulsion or other gelatin-containing composition) which is used to form {by coating) the photographic layer.

Organic solvents for dispersing -photographic additives are well known in the art, as disclosed for example in U.S. Pat. Nos. 2,322,027, 2,801,171, 2,835,579, 2,533,514, 3,554,755, 3,748,141, 3,799,765, 4,353,979, 4,430,421 and 4,430,422.

In particular, esters of aliphatic carboxylic acids have been described, for dispersing photographic additives, in U.S. Pat. No. 2,322,027 (such as tetrahydrofurfuryl succinate, ethyl benzyl malonate, α-naphthyl acetate), in U.S. Pat. No. 3,748,141 (such as quinitol di-2-ethylhexanoate and 1,4-cyclohexyl dimethylene-bis-2-ethylhexanoate) and in U.S. Pat. No. 3,779,765 (such as those corresponding to the formula

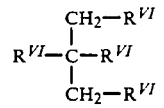

wherein $R^{VI}$ is defined as an alkoxycarbonyl group having up to 15 carbon atoms, particularly two to 13 carbon atoms such as methoxycarbonyl or dodecyloxycarbonyl). Tetrahydrofurfuryl adipate has been reported in U.S. Pat. Nos. 2,801,171 and 2,949,360 as water-soluble organic solvent to be used as auxiliary solvent (in addition to the high boiling organic crystalloidal solvents) and removed from the emulsion by washing with water.

Organic solvents for dispersing hydrophobic photographic additives are required to meet several needs. They must (a) possess an excellent dissolving power towards said additives, (b) not cause crystallization of additives, (c) keep the fine droplets stably dispersed, (d) have a refractive index which is as close as possible to that of the hydrophilic colloid in which they are dispersed, and (e) not deteriorate the physical properties of the layers in which they are incorporated. Moreover, said organic solvents should not negatively affect the photographic properties of the photographic materials in which they are used to disperse photographic additives. For example, they must not give rise to fogging of the light-sensitive silver halide emulsions, and not negatively affect the stability during storage of dye-forming couplers (dispersed with said organic solvents) and of the dyes formed from said couplers during processing (stability to heat, humidity and light).

Accordingly, there is a continuous need for providing improved water-immiscible high boiling organic solvents for use in photography to disperse hydrophobic additives and for providing improved techniques for incorporating said additives into photographic layers.

SUMMARY OF THE INVENTION

The present invention refers to the use of aliphatic diesters of alkylenedicarboxylic acid compounds as water-immiscible high boiling organic solvents for dispersing hydrophobic photographic additives into hydrophilic colloid compositions which are incorporated in the component layers of light-sensitive silver halide photographic materials.

In particular, said aliphatic diester of alkylenedicarboxylic acid compounds correspond to the general formula

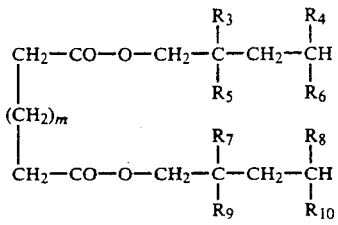

wherein $R_3$, $R_4$, $R_5$, $R_6$, $R_7$, $R_8$, $R_9$, and $R_{10}$, equal or different, each represents a hydrogen atom or a lower alkyl group, with the proviso that at least one of $R_3$, $R_5$, $R_7$ and $R_9$, is an alkyl group or at least one pair of $R_4$ and $R_6$ or $R_8$ and $R_{10}$ are both alkyl groups and the total number of carbon atoms in $R_3$, $R_4$, $R_5$ and $R_6$ and the total number of carbon atoms in $R_7$, $R_8$, $R_9$, and $R_{10}$ is, each, less than 12, and m is a positive integer from 0 to 10.

DETAILED DESCRIPTION OF THE INVENTION

The present invention relates to a light-sensitive silver halide photographic material comprising a support and at least one hydrophilic colloid layer coated thereon, said hydrophilic colloid layer containing hydrophobic photographic additives dispersed in fine droplets of one or more water-immiscible high boiling organic solvents, wherein at least one of said solvents is an aliphatic diester of an alkylenedicarboxylic acid compound. That is, said solvent is a diester of an aliphatic alcohol compound with an α,Ω-alkylenedicarboxylic acid compound. α,Ω-alkylenedicarboxylic acid compounds suitable for the preparation of said solvents have alkylene groups having from 2 to 12 carbon atoms, e.g. 1,2-ethanedicarboxylic acid (succinic acid), 1,3-propanedicarboxylic acid (glutaric acid), 1,4-butanedicarboxylic acid (adipio acid), 1,5-pentanedicarboxylic acid (pimelic acid), 1,6-hexanedicarboxylic acid (suberic acid), 1,7-heptanedicarboxylic acid (azelaic acid) and 1,8-octanedicarboxylic acid (sebacic acid). Aliphatic alcohol compounds suitable for the preparation of said solvents are the saturated alcohol compounds having the general formula $C_mH_{2m+1}$—OH and from 1 to 15 carbon atoms. Illustrative examples of aliphatic alcohol compounds are the following alcohol compounds: methyl, ethyl, n-propyl, iso-propyl, n-butyl, iso-butyl, sec.-butyl, tert.-butyl, n-amyl, iso-amyl, tert.-amyl, n-hexyl, n-heptyl, n-octyl, n-decyl, n-undecyl, n-tetradecyl, 2-ethyl-n-butyl and neo-pentyl alcohols, methyl n-propyl carbinol, diethyl carbinol, sec.-butyl carbinol and tert.-butyl carbinol. Unsaturated aliphatic alcohol compounds, such as allyl alcohol, propargyl alcohol and crotonyl alcohol, may also be used.

Particularly, the present invention relates to a light-sensitive silver halide photographic material as described above, wherein said aliphatic diesters of alkylenedicarboxylic acid compounds are represented by the general structural formula (I)

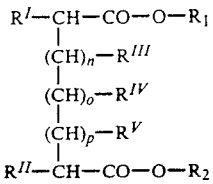

(I)

wherein $R^I$, $R^{II}$, $R^{III}$, $R^{IV}$ and $R^V$, the same or different each represents a hydrogen atom or an alkyl group having 1 to 4 carbon atoms, $R_1$ and $R_2$, the same or different, each represents an alkyl group having 1 to 15 carbon atoms, including straight or branched chain alkyl group, the total number of carbon atoms represented in $R_1+R_2$ is at least 4 and n+o+p is a number from 0 to 10.

Preferably the present invention relates to a light-sensitive silver halide -photographic material as described above, wherein said aliphatic diesters of alkylenedicarboxylic acid compounds are represented by the general structural formula (II)

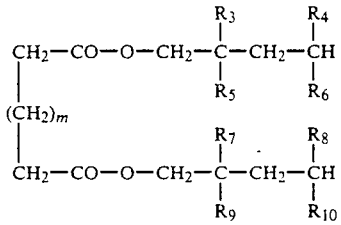

(II)

wherein $R_3$, $R_4$, $R_5$, $R_6$, $R_7$, $R_8$, $R_9$ and $R_{10}$, equal or different, each represents a hydrogen atom or a lower alkyl group, particularly an alkyl group having one to four carbon atoms (such as methyl, ethyl, isopropyl, butyl), with the proviso that at least one of $R_3$, $R_5$, $R_7$ and $R_9$, is an alkyl group or at least one pair of $R_4$ and $R_6$ or $R_8$ and $R_{10}$ are both alkyl groups and the total number of carbon atoms in $R_3$, $R_4$, $R_5$ and $R_6$ and the total number of carbon atoms in $R_7$, $R_8$, $R_9$, and $R_{10}$ is, each, less than 12, and m is a positive integer from 0 to 10 and preferably from 2 to 6. Amongst the combinations of groups useful in this invention are combinations wherein $R_3$ and $R_7$ are ethyl or $R_4$, $R_6$, $R_8$ and $R_{10}$ are each methyl.

The organic solvents for dispersing hydrophobic photographic additives of the present invention are liquid or pasty solid compounds at room temperature, usually have a solubility in water of at most 1% by weight at 20° C. and a boiling point higher than 170° C.

Representative examples of water-immiscible high boiling organic solvents according to the present invention, in which $R^I$, $R^{II}$, $R^{III}$, $R^{IV}$ and $R^V$ are hydrogen, are exemplified below.

| Compound | m (n + o + p) | $R_1$ | $R_2$ |
|---|---|---|---|
| (1) | 5 | $-CH_2-\underset{\underset{C_2H_5}{\vert}}{CH}-C_4H_9$ | $-CH_2-\underset{\underset{C_2H_5}{\vert}}{CH}-C_4H_9$ |
| (2) | 0 | $-CH_2-\underset{\underset{C_2H_5}{\vert}}{CH}-C_2H_5$ | $-CH_2-\underset{\underset{C_2H_5}{\vert}}{CH}-C_2H_5$ |

-continued

| Compound | m (n + o + p) | $R_1$ | $R_2$ |
|---|---|---|---|
| (3) | 6 | $-CH(C_2H_5)-(CH_2)_3-CH_3$ | $-CH(C_2H_5)-(CH_2)_3-CH_3$ |
| (4) | 6 | $-CH(C_2H_5)-(CH_2)_3-CH_3$ | $-CH_3$ |
| (5) | 4 | $-C_4H_9$ | $-C_4H_9$ |
| (6) | 6 | $-CH_2-CH(C_2H_5)-C_4H_9$ | $-CH_2-CH(C_2H_5)-C_4H_9$ |
| (7) | 2 | $-(CH_2)_{10}-CH_3$ | $-(CH_2)_{10}-CH_3$ |
| (8) | 4 | $-(CH_2)_2-CH(CH_3)-CH_3$ | $-(CH_2)_2-CH(CH_3)-CH_3$ |
| (9) | 6 | $-CH(CH_3)-CH_3$ | $-CH(CH_3)-CH_3$ |
| (10) | 4 | $-C_2H_5$ | $-C_2H_5$ |

The water-immiscible high boiling organic solvents above may be synthesized according to procedures well known in the art of organic chemistry for synthesizing aliphatic esters, such as procedures described in *Organic Synthesis* Vol.2, page 264, J. Wiley & Sons (1943) for preparation of diethyl adipate (compound 10).

The present invention also relates to a process for incorporating a hydrophobic photographic additive into a hydrophilic colloid composition for forming the colloid layer of a silver halide photographic material, said process comprising the solution of said photographic additive in one or more water-immiscible high boiling organic solvents and the dispersion of the resulting solution in said colloid composition, wherein at least one of said organic solvents is an aliphatic diester of an alkylenedicarboxylic acid compound as described above.

In the process of dispersing photographic addenda by using organic solvents according to the present invention, different procedures may be satisfactory followed. According to one procedure, the hydrophobic photographic additive to be dispersed is dissolved in the water-immiscible high boiling organic solvent of the present invention. The obtained solution is then added to an aqueous solution of a hydrophilic colloid binder (such as gelatin) and the mixture is emulsified by means of dispersing apparatus (such as a colloidal mill, a homogenizer and the like) in the presence of a dispersing agent (generally a surface active agent, such as an anionic surfactant, a nonionic surfactant, a cationic surfactant or a mixture thereof), said dispersing agent being preferably contained in the hydrophilic colloid binder solution. The obtained dispersion is then added to a gelatin silver halide emulsion or an aqueous solution of a hydrophilic colloid which is used for forming light-sensitive image forming layers or light-insensitive auxiliary layers of silver halide photographic materials. Alternatively, it may advantageous to incorporate the solution of the photographic additive in the organic solvent directly into the coating composition used for forming upon coating the component photographic layer and dispersing the mixture. It is also possible to use the organic solvents of the present invention in combination with other known water-immiscible high boiling organic solvents, even if-the advantages set forth in the present invention can be attained using the present organic solvents alone. High boiling organic solvents which can be used in combination with the present organic solvents are phthalic acid alkyl esters, phosphoric acid esters, citric acid esters, benzoic acid esters, fatty acid esters and the like such as described in U.S. Pat. No. 4,430,421. If desired or necessary, the present high temperature boiling organic solvents can be used in combination with auxiliary low temperature boiling organic solvents. Other known high temperature boiling organic solvents can be used in combination with the organic solvents of the present invention in the presence or less of low temperature boiling organic solvents. Low temperature boiling organic solvents include those which are not soluble or almost not soluble in water (i. e., less than 1% by weight) and having a boiling point of at most 150° C., such as lower alkyl acetates, carbon tetrachloride, methyl ethyl ketone, benzene, ligroine, etc., or water soluble organic solvents such as methanol, ethanol, dimethylsulfoxide, tetrahydrofuran, dioxan, acetone, etc. Auxiliary low boiling organic solvents are for example described in U.S. Pat. Nos. 2,801,170, 2,801,171 and 2,949,360.

The amounts of high boiling solvents used according to this invention for dispersing hydrophobic additives can vary according to the used additive. It is, however, undesirable to use large amounts of such solvents, because large excess of solvents may somehow deteriorate the physical properties of the photographic layers. Accordingly, it is normal practice to use the high boiling solvents in a weight ratio to each additive in the range from 0.1 to 8.0, preferably in the weight ratio range of 0.3 to 3.0.

According to this invention it is possible to improve the stability of hydrophobic photographic additive dispersions. Dye-forming couplers, UV absorbers and other hydrophobic photographic additives can be dispersed into light-sensitive silver halide photographic materials without apparent unevenness in the coating or deterioration of image quality. The present invention is particularly advantageous in light-sensitive silver halide color photographic materials wherein excellent stability to light, heat and/or humidity can be imparted to the dye images obtained upon exposure and development of said materials.

Gelatin is the preferred hydrophilic colloid for use in the present invention. However, other water-soluble colloid substances or mixtures thereof can also be used. Exemplary hydrophilic colloid substances include gelatin derivatives, such as phthalated gelatin and acetylated gelatin, cellulose derivatives, such as carboxymethyl cellulose, starch, casein, zein, synthetic hydrophilic colloids such as polyvinyl alcohol, polyvinyl pyrrolidone, anionic polyurethanes, copolymers of acrylic acid esters, acrylonitrile and acrylamides, etc.

The hydrophobic photographic additives, which are dispersed with the aid of the water-immiscible organic solvents according to the present invention, are those which, when incorporated into the constituent layers of silver halide photographic materials, are required to substantially not diffuse within the layers themselves. A group bearing a ballasting substituent such as a hydrophobic residue with from 8 to 30 carbon atoms is introduced into the photographic additive molecule in order to avoid such diffusing processes. Said substituent is called a "ballasting chain" and is linked, directly or through one or more of imino, ether, carbonamido, sulfonamido, ureido, ester, imido, carbamoyl, sulfamoyl, phenylene, etc., groups, to the photographic additive molecule. Suitable examples of ballasting chains are illustrated in U.S. Pat. No. 4,009,083, in EP 73,146, 84,100, 87,930 and 87,931, in DE 3,300,412 and 3,315,012 and in JP 58-033248, 58-033250, 58-031334 and 58-106539. Preferably, such ballasting chains comprise alkyl groups, the total carbon atoms of which is no more than 20. Usually, said photographic additives have a solubility in water of at most 3% by weight at 20° C. Specifically preferred hydrophobic photographic additives include dye-forming couplers, silver halide developers, oxidized developer scavengers, spectral sensitizers and desensitizers, diffusion transfer dye image-formers, and visible and ultraviolet light absorbers, which are conventionally introduced in hydrophilic colloid layers of photographic elements dispersed in water-immiscible high boiling solvents. Other hydrophobic photographic addenda include those used in silver halide photographic elements such as optical brighteners, antioxidants, silver halide solvents, bleachable dyes and the like. Hydrophobic photographic addenda for use in the present invention are described in more details in Research Disclosure 15930, July 1977.

The silver halide emulsions used in the present invention can be any of the silver halide emulsions known in the art such as silver chloride, silver bromide, silver bromo-chloride, silver chloro-iodide, silver bromoiodide, silver chloro-bromo-iodide emulsions and mixtures thereof. The emulsions can be composed of coarse, medium and fine grains and can be monodispersed or polydispersed. The silver halide grains may be those having a regular crystal form, such as a cube or an octahedron, or those having an irregular crystal form, such as a sphere or tablet, etc., or may be those having a composite crystal form. They may be composed of a mixture of grains having different crystal forms. Their size can be varied on a wide range, but in general average grain sizes from 0.1 to 4 μm are suitable.

The silver halide emulsions used in the present invention may be obtained according to any of the known acid, neutral and ammoniacal method using conventional precipitation methods such as a single or twin jet method. Further, the silver halide emulsions may be chemically sensitized with a sulfur sensitizer, such as allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination.

Furthermore, the above silver halide emulsions may contain various known additives for photography. For example, there may be employed additives for photography as disclosed in Research Disclosure, Item 17643, December 1978.

Moreover, the silver halides may be optically sensitized to a desired region of the visible spectrum. The method for spectral sensitization of the present invention is not particularly limited. For example, optical sensitization may be possible by using an optical sensitizer, including a cyanine dye, a merocyanine dye, complex cyanine and merocyanine dyes, oxonol dyes, hemioxonol dyes, styryl dyes and streptocyanine dyes, either alone or in combination. Particularly useful optical sensitizers are the dyes of the benzoxazole-, benzimidazole- and benzothiazole-carbocyanine type.

The above emulsions may also contain various additives conveniently used depending upon their purpose. These additives include, for example, stabilizers or antifoggants such as azaindenes, triazoles, tetrazoles, imidazolium salts, polyhydroxy compounds and others; film hardeners such as of the aldehyde. aziridine, isoxazole, vinylsulfone, acryloyl, triazine type, etc.; developing promoters such as benzyl alcohol, polyoxyethylene type compounds, etc.; image stabilizers such as compounds of the chromane, cumaran, bisphenol type, etc.; and lubricants such as wax, higher fatty acids glycerides, higher alcohol esters of higher fatty acids, etc. Also, coating aids, modifiers of the permeability in the processing liquids, defoaming agents, antistatic agents and matting agents may be used. As hydrophilic colloids to be used in the emulsion according to the present invention, not only gelatin but also gelatin derivatives, polymer grafts of gelatin, synthetic hydrophilic macromolecular substances and natural hydrophilic macromolecular substances other than gelatin may also be available either singly or in a mixture. Also, synthetic latexes may be added to gelatin to improve the film properties such as copolymers of acrylic acid esters, vinyl esters, etc., with other monomers having ethylenic groups.

As the support for the light-sensitive element, there may be used, for example, baryta paper, polyethylene-coated paper, polypropylene synthetic paper, cellulose acetate, polystyrene, a polyester film such as polyethyleneterephthalate, etc. These supports may be chosen depending upon the purpose of use of the light-sensitive silver halide photographic material. The supports may be provided with a subbing layer, if necessary.

The photographic emulsions used in the present invention can be used for black-and-white light-sensitive negative elements, light-sensitive positive elements, X-Ray elements, lithographic elements, black-and-white and color light-sensitive elements for diffusion transfer processes and light-sensitive elements which contain oil-soluble or water-soluble color couplers.

Preferably, the silver halide emulsions according to the present invention are designed for multicolor elements comprising dye image forming units sensitive to three different portions of the spectrum such as to each of the three primary regions (blue, green and red) of the visible spectrum. Each unit can be formed by a single emulsion layer or multiple emulsion layers sensitive to the same spectral region. The layers may be sensitized with false color addressing as shown in U.S. Pat. No. 4,619,892.

More preferably, the silver halide emulsions according to the present invention are designed for a multicolor element comprising a support bearing at least one blue-sensitive silver halide emulsion layer and preferably two blue-sensitive silver halide emulsion layers of different sensitivity associated with yellow dye forming couplers, at least one green sensitive silver halide emulsion layer and preferably at least two green-sensitive silver halide emulsion layers of different sensitivity associated with magenta dye forming couplers, at least one red-sensitive silver halide emulsion layer and preferably at least two red-sensitive silver halide emulsion layers of different sensitivity associated with cyan dye forming couplers, and additional non light-sensitive hydrophilic colloid layers such as protective layers, intermediate layers, filter layers, subbing layers, backing layers and the like), wherein at least one component layer of said material comprises incorporated therein a hydrophilic photographic additive dispersed with the aid of a water-immiscible high boiling organic solvent according to the present invention, said component layers comprising preferably at least one silver halide emulsion layer including a dye forming coupler.

The following examples further illustrate the invention.

EXAMPLE 1

A solution was obtained by dissolving 10 g of the yellow forming coupler having the structural formula:

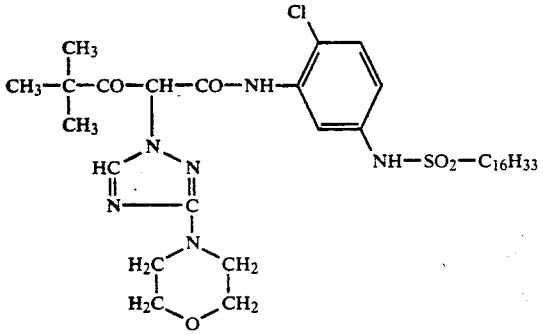

in a mixture of 5 ml of high boiling solvent (1) and 10 ml of ethylacetate as an auxiliary solvent at 60° C. The solution was incorporated in 24 ml of a 10% gelatin solution containing 6 ml of a 5% Nekal TM BX (an alkylnaohthalenesulphonic acid sodium salt of BASF AG) solution and the composition stirred with a rotary mixer at 10,000 r.p.m. and added with 44 ml of water during stirring. The resulting emulsified dispersion was added to a blue-sensitive AgBrI emulsion (having 8% AgI mole and 1.02 μm average grain diameter), chemically ripened with gold and thiosulfate and added with stabilizers. The emulsion including the dispersed coupler was coated at a silver coverage of 1.2 g/m$^2$ and coupler coverage of 1.40 g/m$^2$ on a cellulose triacetate support base (film 1 of the invention).

Another film (film 2 of the invention) was obtained by repeating the same procedure above, using in place of the high boiling solvent (1) the same amount of high boiling solvent (6).

Comparison films 3, 4 and 5 were obtained by repeating the same procedure above, except that in place of the present high boiling solvent (1), there were used the same amount of di-n-butylphthalate, di-n-butylphthalate in 1:1 by weight mixture with diethylauramide and 1,4-cyclohexyldimethylene-bis-(2-ethylhexanoate) (high boiling solvent No. 6 of U.S. Pat. No. 3,748,141), respectively.

Samples of each film were exposed to a light source having a color temperature of 5,500° Kelvin through an optical step wedge and developed in a standard type C41 process as described in British Journal of Photography, July 12, 1974, pp. 597–598.

The following Table 1 reports the values of fog of samples conditioned for 22 hours at 70° C. before exposure and processing (Fog), the percent of loss in maximum density between samples of a film conditioned for one week at 38° C. before exposure and processing and unconditioned samples of the same film (δ Dmax), the transparency of developed samples evaluated with a subjective scholastic rating wherein 1 is the worst and 10 is the best (Transp.) and RMS granularity, that is a measure of diffuse granularity, as described in H. C. Schmitt and J. H. Altman, "Method of Measuring Diffuse RMS Granularity", Applied Optics, Vol. 9, pages 871–874, April 1970, at various optical densities (RMS).

TABLE 1

| | | | | RMS | | |
|---|---|---|---|---|---|---|
| Film | Fog | δ Dmax | Transp. | OD = 0.4 | OD = 1.0 | OD = 1.4 |
| 1 | 0.11 | −13 | 7 | 7.0 | 5.4 | 4.0 |
| 2 | 0.13 | −14 | 6 | 8.0 | 5.5 | 4.1 |
| 3 | 0.21 | −21 | 4 | 9.3 | 7.8 | 6.1 |
| 4 | 0.16 | −27 | 4 | 10.0 | 7.1 | 5.4 |
| 5 | 0.21 | −17 | 7 | 8.0 | 6.0 | 5.3 |

The example shows that the photographic and optical characteristics of films containing the high boiling solvents of the present invention are superior to that of films containing known high boiling solvents.

We claim:

1. A light-sensitive silver halide photographic material comprising a support and a hydrophilic colloid layer coated thereon, said hydrophilic colloid layer containing droplets consisting essentially of hydrophobic photographic additives dispersed in fine droplets of one or more water-immiscible high boiling organic solvents, wherein at least one of said solvents is an aliphatic diester of an alkylenedicarboxylic acid compound corresponding to the general structural formula

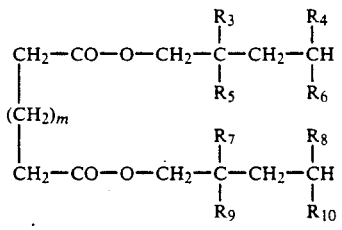

wherein $R_3$, $R_4$, $R_5$, $R_6$, $R_7$, $R_8$, $R_9$, and $R_{10}$, equal or different, each represents a hydrogen atom or a lower alkyl group, with the proviso that at least one of $R_3$, $R_5$, $R_7$ and $R_9$, is an alkyl group or at least one pair of $R_4$ and $R_6$ or $R_8$ and $R_{10}$ are both alkyl groups and the total number of carbon atoms in $R_3$, $R_4$, $R_5$ and $R_6$ and the total number of carbon atoms in $R_7$, $R_8$, $R_9$ and $R_{10}$ is, each, less than 12, and m is 0 to 10.

2. The light-sensitive silver halide photographic material of claim 1, wherein said hydrophobic photographic additive is a dye-forming coupler.

3. The light-sensitive silver halide photographic material of claim 1, wherein said hydrophilic colloid layer is a gelatin layer.

4. The light-sensitive silver halide photographic material of claim 1, wherein said hydrophilic colloid layer is a gelatin silver halide emulsion layer.

5. The material of claim 1 wherein $R_3$ and $R_7$ are ethyl.

6. The material of claim 2 wherein $R_3$ are $R_7$ are ethyl.

7. The material of claim 3 wherein $R_3$ and $R_7$ are ethyl.

8. The material of claim 4 wherein $R_3$ and $R_7$ are ethyl.

9. The material of claim 1 wherein $R_4$, $R_6$, $R_8$ and $R_{10}$ are each methyl.

10. The material of claim 2 wherein $R_4$, $R_6$, $R_8$ and $R_{10}$ are each methyl.

11. The material of claim 3 wherein $R_4$, $R_6$, $R_8$ and $R_{10}$ are each methyl.

12. The material of claim 4 wherein $R_4$, $R_6$, $R_8$ and $R_{10}$ are each methyl.

13. A process for incorporating fine droplets consisting essentially of a hydrophobic photographic additive dispersed in one or more water-immiscible high boiling organic solvents into a hydrophilic colloid composition for forming a photographic layer which comprises dissolving said hydrophobic additive in said one or more water-immiscible high boiling organic solvents and dispersing the resulting solution in said hydrophilic colloid composition, wherein at least one of said organic solvents is an aliphatic diester of an alkylenedicarboxylic acid compound corresponding to the general structural formula

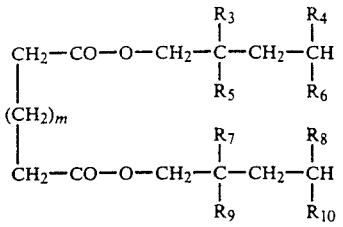

wherein $R_3$, $R_4$, $R_5$, $R_6$, $R_7$, $R_8$, $R_9$, and $R_{10}$, equal or different, each represents a hydrogen atom or a lower alkyl group, with the proviso that at least one of $R_3$, $R_5$, $R_7$ and $R_9$, is an alkyl group or at least one pair of $R_4$ and $R_6$ or $R_8$ and $R_{10}$ are both alkyl groups and the total number of carbon atoms in $R_3$, $R_4$, $R_5$ and $R_6$ and the total number of carbon atoms in $R_7$, $R_8$, $R_9$, and $R_{10}$ is, each, less than 12, and m is 0 to 10.

14. The process of claim 13 wherein said hydrophilic colloid composition is a gelatin aqueous composition.

15. The process of claim 13 wherein said hydrophobic additive is a dye-forming coupler.

16. The process of claim 13 wherein said hydrophobic additive is dissolved in said water-immiscible high boiling organic solvents in the presence of a low boiling auxiliary organic solvent.

17. The process of claim 13 wherein $R_3$ and $R_7$ are ethyl.

18. The process of claim 13 wherein $R_4$, $R_6$, $R_8$ and $R_{10}$ are each methyl.

* * * * *